US006100921A

United States Patent [19]

Rowley

[11] Patent Number: 6,100,921

[45] Date of Patent: Aug. 8, 2000

[54] THRU-HULL VIDEO CAMERA

[76] Inventor: Steven R. Rowley, 5413 SE. Schooner Oaks Way, Stuart, Fla. 34997

[21] Appl. No.: 09/075,985

[22] Filed: May 11, 1998

[51] Int. Cl.[7] ..... H04N 7/18

[52] U.S. Cl. ..... 348/81; 348/148

[58] Field of Search ..... 348/61, 81, 82, 348/83, 143, 148, 151

[56] References Cited

U.S. PATENT DOCUMENTS 4,346,404 8/1982 Gantenbrink ..... 348/81
4,809,630 3/1989 Walker ..... 114/66
4,965,601 10/1990 Canty ..... 348/81
4,977,418 12/1990 Canty ..... 348/81

*Primary Examiner*—Bryan Tung
*Attorney, Agent, or Firm*—McHale & Slavin

[57] ABSTRACT

The instant invention is a video camera assembly which is adapted to be mounted in a thru-hull fitting so as to allow for safe and dependable viewing in various environments. A primary embodiment of the invention allows for underwater viewing by use of a conventional thru-hull fitting found on most boats. The camera includes a modified transducer body with a self-contained miniaturized camera available for coupling to a television or video monitor in a safe and protected location.

7 Claims, 3 Drawing Sheets

THRU-HULL VIDEO CAMERA

FIELD OF THE INVENTION

This invention relates to the field of video cameras and more particularly, to a video camera mounted in a thru-hull fitting.

BACKGROUND OF THE INVENTION

Various aquatic endeavors, such as fishing, diving, snorkeling and boating in general, make it desirable to be able to view beneath the water surface. To accomplish this viewing, numerous viewing devices have been utilized from simplistic transparent panels to elaborate electronic devices.

For instance, a basic underwater viewing device can be a rigid transparent panel that is built into the hull of a boat. Such vessels, also known as "glass-bottom boats" are popular with tourists since they allow for a safe and easy way of viewing the world beneath the ocean's surface. However, such transparent panels have limited structural integrity requiring special hull modification and requires viewing directly through the panel.

Various sonar devices, including depth and fish finders have also been used in an effort to create a visual interpretation, based upon sonar feedback, of the underlying geography. This type of information is very important when fishing or when merely trying to navigate through shallow water.

Modern electronics allow on-board displays of the underwater environment utilizing the signal from a small video camera placed beneath the surface. One known electronic display devices employs a camera enclosed in a watertight housing secured to a long handle that allows for positioning of the camera beneath the water surface along the side of the vessel. Alternatively, the camera can be attached to a cable which allows it to be submerged at a specified depth and towed behind the vessel at fairly high speeds, e.g. up to 12 knots,. The problem with these devices is that they necessarily suffer from being dragged through the water. When supported by a handle, a great deal of drag is created, thereby making it difficult for the operator to effectively support the camera. Unacceptable vibration and movement occurs which results in a blurred image and an inability to maintain the desired aiming of the camera. When towed behind the boat, similar problems occur with vibration and aiming. Furthermore, the camera is subject to damaging entanglements and impacts with submerged devices, fishing lines, the boat or even the boat propellers.

What is lacking in the art is a means for viewing beneath the surface by use of a camera mounted in such a way that it is in visual contact with the area beneath the vessel, while not incurring a degradation of visual acuity or suffering the type of physical damage which is concomitant with being positioned outside of the vessel.

SUMMARY OF THE INVENTION

The present invention is a video camera assembly constructed and arranged so as to be sealingly engaged with a thru-hull fitting. The assembly may take the shape of a rigid cylindrical sleeve having a proximal and a distal end and may be composed of a metal, such as aluminum, bronze, stainless steel or a particular plastic resin which has suitable characteristics, for example a glass reinforced resin. The proximal end is configured so as to have a transparent panel in sealing engagement therewith. The transparent panel may be constructed utilizing a suitable material such as a tempered glass or PYREX® glass, a mineral material, such as fused silica, or a suitable resin such as an acrylic or polycarbonate. The transparent panel may be positioned so as to define a field of view either parallel or perpendicular to the axis defined by the cylindrical sleeve. The sleeve is designed so as to have at least one resilient member arranged so as to sealingly and removably engage the thru-hull fitting.

In a preferred embodiment, a pair of resilient O-rings are seated in grooves at the distal end of the sleeve. The resilient member may be formed from various natural or synthetic elastomers, for example nitrile rubber, fluoroelastomers and silicone. The video camera contained within said rigid cylindrical sleeve has a lens and communicating cables. One of the communicating cables provides power, generally in the form of 9.6–12 VDC. The other cable provides a video signal which may be input to a monitor or VCR. The camera is positioned so that the lens is juxtaposed the transparent panel. The cables extend from and are sealingly engaged with the distal end of the sleeve.

The camera assembly further includes securing means for maintaining said sleeve in sealing engagement with said thru-hull fitting. The securing means may be a threaded end cap having a surface which engages the distal end of the camera assembly and urges it into a tight engagement with the thru-hull fitting when it is threaded thereon. The camera assembly may also be constructed so as to define a plurality of circumferential flanges serially arranged and concentrically spaced along the cylindrical sleeve and having the resilient members positioned therebetween.

Thus it is an objective of the present invention to provide a video camera which may be mounted on a vessel and maintained in visual contact with the area beneath the vessel while. eliminating forces which might damage the camera or otherwise reduce the visual acuity thereof.

It is a further objective of the invention to provide a video camera which can be mounted utilizing a thru-hull fitting.

It is yet another objective of the invention to provide a camera assembly having alternative fields of view.

It is a still further objective of the invention to provide a camera assembly which may be mounted within a wall of any style vehicle including, but not limited to, cars, buses, trains, airplanes, semi-trailers, and which provides for ease of removal, cleaning and replacement.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DESCRIPTION OF THE PREFERRED EMBODIMENT(S)

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
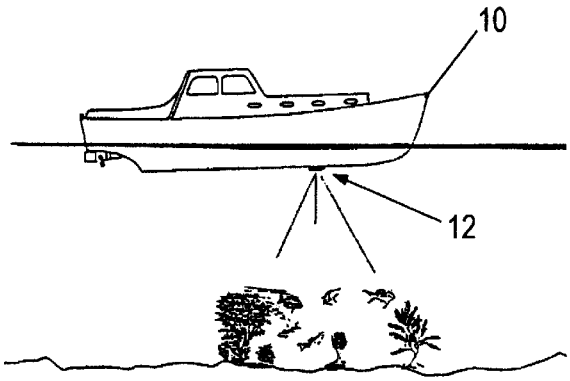
FIG. 1 is a pictorial view of the device mounted in a power boat.
Figure 1A:
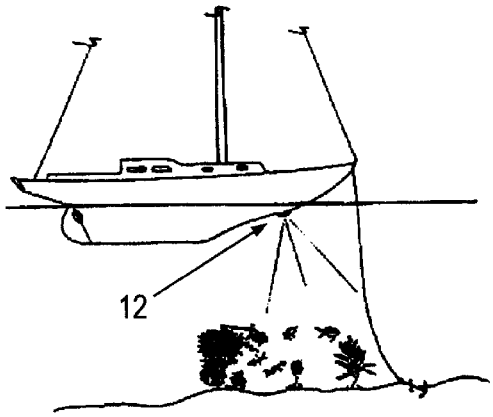
FIG. 1A is a pictorial view of the device mounted in a sailboat.

Now referring to FIG. 1, a pictorial view of a powerboat 10 is shown floating over a reef. The instant camera assembly 12 has been mounted in a thru-hull fitting of the powerboat so as to enable visualization of the area beneath the powerboat. As will be described later in this specification, the thru-hull fitting holder may be manufactured by Raytheon, Furuno, Si-Tex, Humminbird, Interphase, Apelco or the like fitting holders that are used to secure frequency sounders or the like transducers. The camera assembly may be placed within a modified housing of any such thru-hull transducer style housing allowing an individual to substitute the camera assembly for a plug or operating transducer.

Unique to this invention is the ability to insert the camera assembly by removal of a conventional transducer, as described in detail later in this invention. The substitution allows for ease of installation as well as multiple uses of a thru-hull fitting. The thru-hull provides a stable viewing platform that is submersed at all times and eliminates interference from cavitation and surface debris. The use of a thru-hull further allows the camera assembly to be readily removed for service, or removed if the boat is moored for any length of time.

The removal of the camera assembly allows an uncoated viewing lens. Boats typically employ a specially formulated bottom paint tailored to prevent bottom growth wherein the paint is used to cover the exposed parts of the boat bottom including transducers. Should the boat be moored for any length of time the paint prevents the bottom growth. The removal allows the video camera to be removed while the boat is moored to prevent growth on the lens or any other type of discolorization that would affect optimum viewing without coating of the lens.

The camera assembly allows underwater viewing by use of a conventional television from the comforts of the cabin. An individual may watch the array of fish and coral beneath the boat without having to be a scuba diver or snorkeler. In addition, the actions of divers can be monitored and video taped.

The camera assembly can also be used to enhance the frequency sounder of a boat, whether it be a depth finder or a fish finder, by optical viewing. It should be noted, that water causes an increase in magnification of approximately 25% providing a natural enhancement to the viewing.

FIG. 1(*a*) depicts a sailboat having the camera assembly installed to provide all the advantages previously described and by forward placement allow the monitoring of an anchor. Since sail boaters may anchor for extended periods of time, the camera provide a view of the anchor positioning to determine whether the anchor is dragging or snagged. It is common for a boater to drop an anchor and then jump overboard to determine if the anchor has set properly. The instant invention eliminates the need for overboard checking and allows the boater an instant way of monitoring the anchor position and determining if chaffing of the line is occurring.

Figure 2:
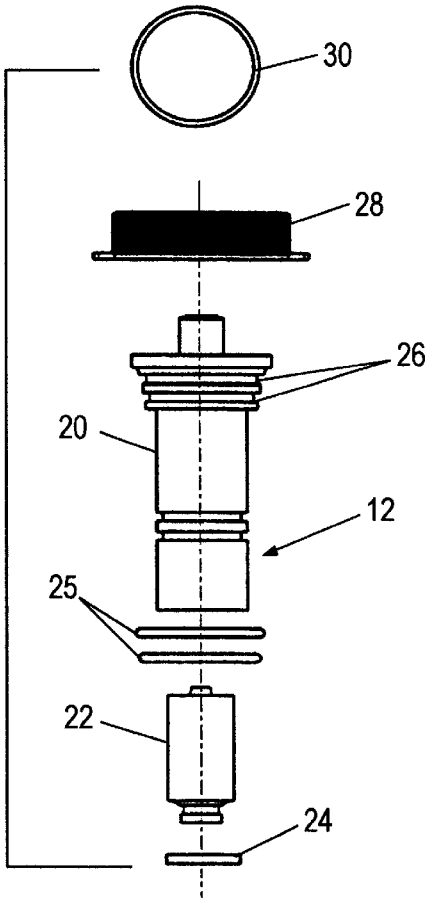
FIG. 2 is an exploded view of a particular embodiment of the device.

Referring to FIG. 2, the assembly 12, having a rigid cylindrical sleeve 20 is designed so as to house the camera 22. When the camera has been inserted into the sleeve, a transparent panel 24 seals the proximal end of the sleeve and allows the camera to be trained upon a visual field. As shown, the visual field is in line with the axis of the cylindrical sleeve; however in alternative embodiments, the transparent panel may be inserted in the side of the sleeve so as to allow a field of view which is perpendicular to the axis of the sleeve. Resilient members, 25 are seated in grooves 26 so as to provide a watertight seal when the assembly is inserted into a standard thru-hull fitting. End cap 28 will be threaded onto the thru-hull fitting and thereby urge the resilient members, which in a preferred embodiment are elastomeric O-rings, into sealing engagement with the thru-hull fitting. Safety ring 30 is inserted into a pre-formed hole in the distal end of the assembly and aids the technician during insertion or extraction of the assembly. The camera may be color, black/white, and of any processor including analog, digital, CCD or the like.

Figure 3:
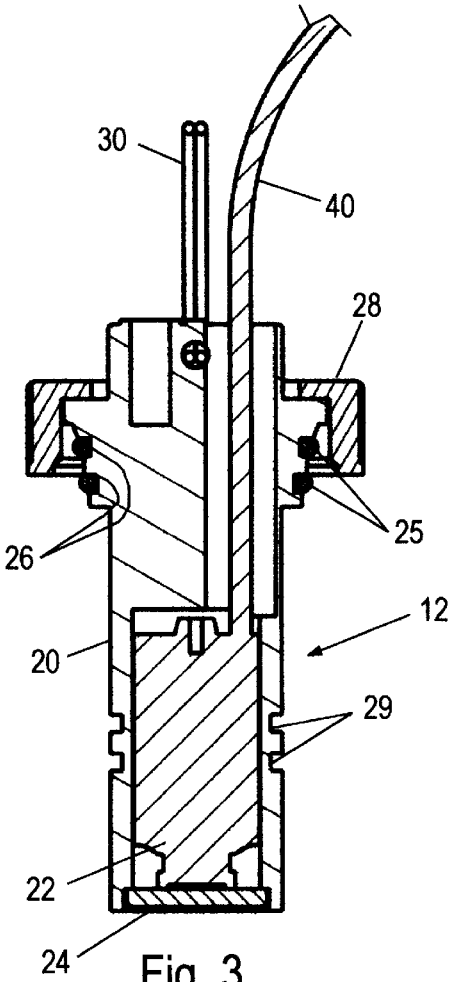
FIG. 3 is cross-sectional view of the device.

Referring to FIG. 3, set forth is a cross-sectional view of the assembly 12 wherein the cylindrical sleeve 20 has been modified to have a lower hollowed section for placement of a miniaturized camera 22. The camera is sized to frictionally engage the side-walls of the cavity or be epoxed in position with placement of the transparent viewing panel 24, which seals the proximal end of the housing 20. Electrical wiring 40 extends through an upper cavity for use in connecting to the power source and video output such as a television camera. The wire 40 is also epoxed in place providing a permanent solid seal in the thru-hull housing with sealing provided by O-rings 25 and, depending upon the thru-hull fitting, grooves 29 are available for additional O-rings providing a water tight seal in the side surface of the boat and the water.

Figure 4:
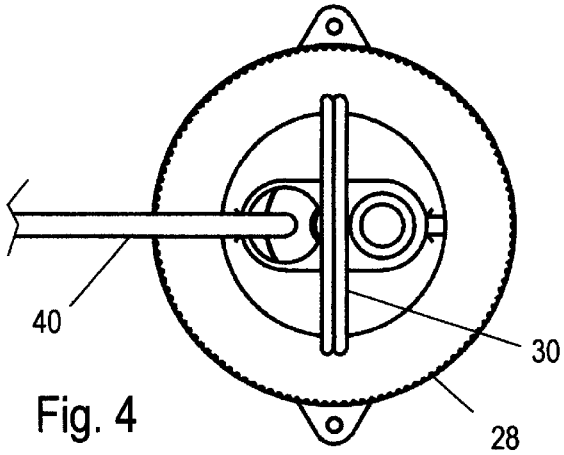
FIG. 4 is a top-view of the device.
Figure 4A:
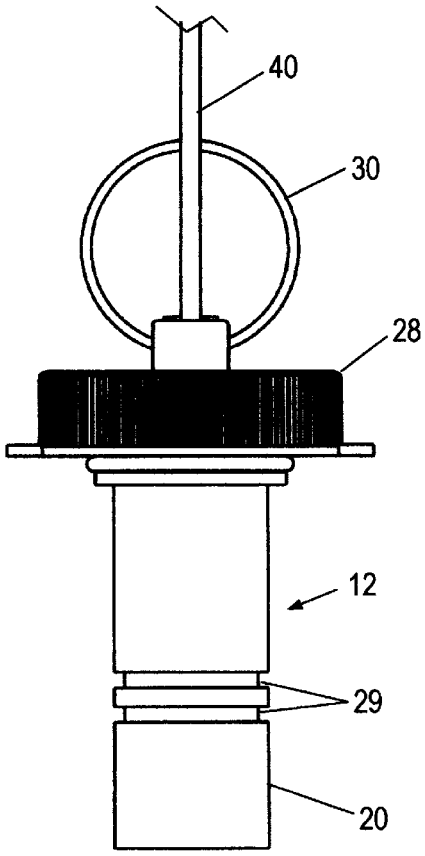
FIG. 4A is a side view of the camera assembly.
Figure 4B:
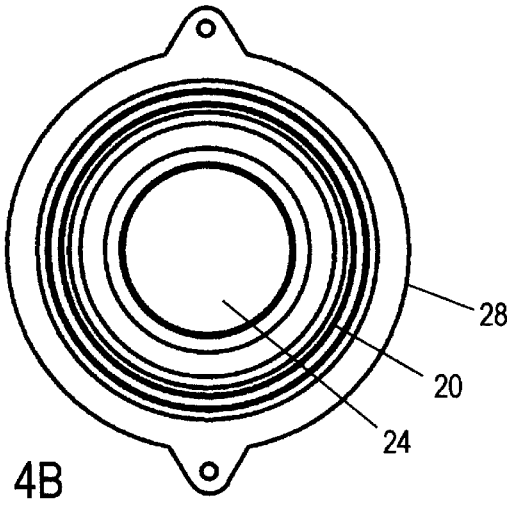
FIG. 4B is an end view of the camera assembly.

Referring to FIG. 4, this figure shows a top view of the assembly wherein the cables 40 exit from an aperture in the top of the distal end of the sleeve 20. The cables may be sealed within the aperture by use of a potting material, such as an epoxy resin. In an alternative embodiment, a resilient grommet (not shown) may be utilized which surrounds the cable and is compressed so as to sealingly engage said aperture.

FIG. 4(*a*) sets forth a side view of the camera assembly 12. In the assembled form, the camera looks exactly like any other type of transducer set through a thru-hull fitting except for the viewing panel 24 located on the end of the housing 20. It is noted, that the viewing panel can be easily cleaned by removal of the assembly 12 by un-threading cap 28 and simply removing the assembly from the thru-hull fitting. This operation can be done while in the water as an experienced individual can easily withdraw an assembly and insert a new transducer or plug in its place while servicing of the camera is performed.

Figure 5:
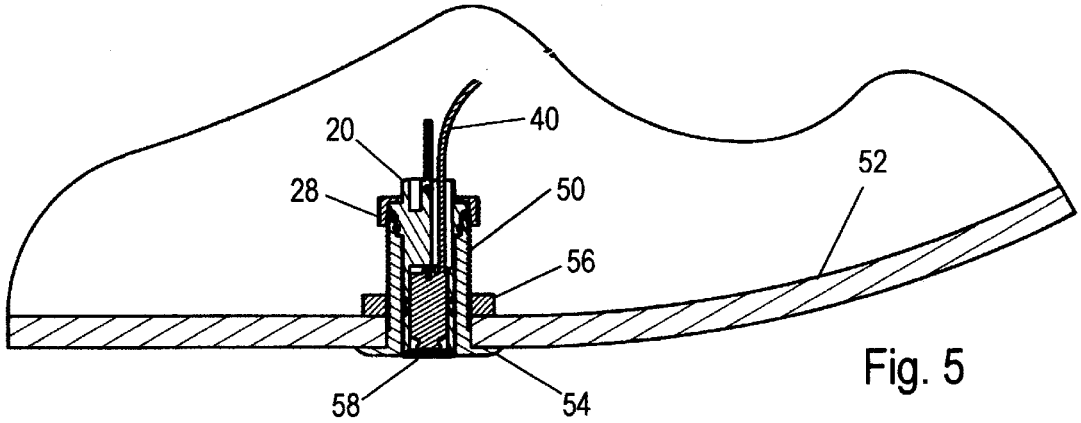
FIG. 5 is a cross-sectional view of the device mounted through the hull of a vessel.
Figure 6A:
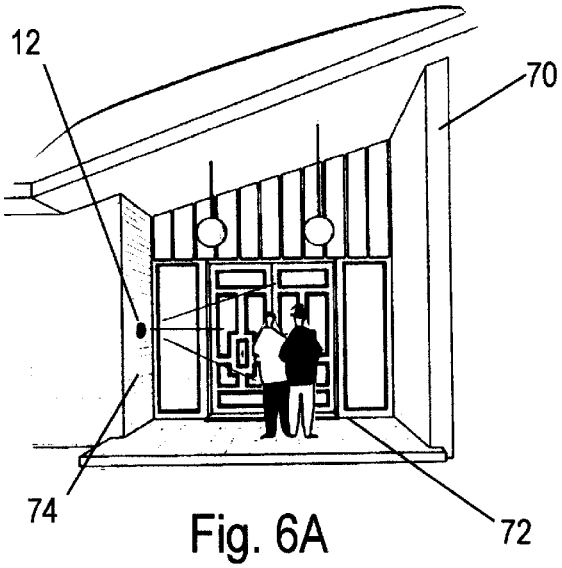
FIG. 6A is a pictorial view of the device mounted in a wall to view outside occupants.
Figure 6B:
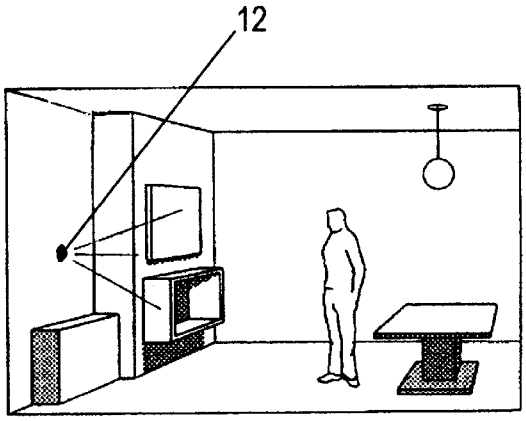
FIG. 6B is a pictorial view of the device mounted in a wall to view occupants in a hazardous area.
Figure 6C:
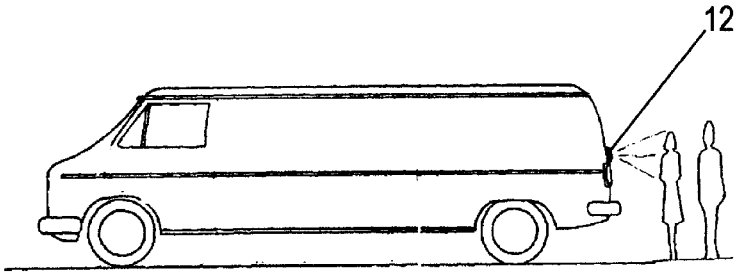
FIG. 6C is a pictorial view of the device mounted in a back wall of a van to view a blind area.
Figure 6D:
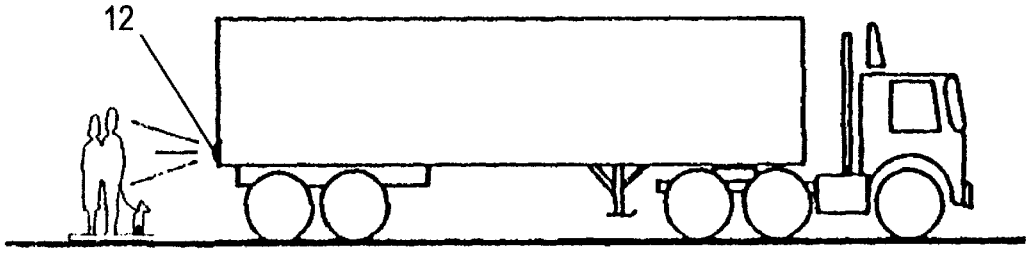
FIG. 6D is a pictorial view of the device mounted in a back wall of a semi-truck to view a blind area.

Referring to FIG. 5, the sleeve 20 is shown inserted into a thru-hull fitting 50 and urged into a sealing engagement therewith by end cap 28. The cables 40 are then routed to a power source and video display within the vessel. The thru-hull fitting 50 typically includes a bronze or non-ferrous external coupling 54 which is operatively associated with an internal coupling 56 for holding of a threaded sleeve 58. Once installed, the thru-hull fitting 50 is permanently secured to the hull and removed only if a thru-hull filling should crack or otherwise deteriorate. The thru-hull fitting 50 provides a stable base for the cameral assembly.

The camera assembly may have a field of view in a direction parallel to the axis of the sleeve or be predisposed at an angle that exemplifies the optimum viewing angle beneath of a boat, such as 30 degrees. The actual viewing angle may be between 0 and 90 degrees and the device may include a means for rotation and angular positioning of the camera. In this manner, a dive boat could employ the instant invention and include a provision for rotation of the camera to allow viewing of the propeller and dive platform area of the boat. Inexperienced divers or divers boarding a boat in high seas can easily be injured by the movement of the swim platforms and propeller and requires careful monitoring. Angular positioning further allows a dive boat to monitor the divers location while beneath the boat as well as search for lost divers.

Now referring to FIG. 6(*a*) shown is a pictorial view of another example of how the thru-hull video assembly 12 may be used. This embodiment depicts the outside of a home 70 having a front door 72 and the video assembly 12 located along wall 70 for what could be considered monitoring of the entry porch. This embodiment discloses a discrete placement that can be removed for cleaning from inside the residence. While remote video cameras are not new for such a position, the video camera is not only used for annunciation of a visitor but also to screen unwanted occupants. It is noted that an unwanted occupant can easily disable a conventional video camera mounted on the outside wall of a home or business requiring the owner to leave the safety of the premises to fix the camera. This results in a breach of their security by opening the door to determine who is on the porch thereby disabling the purpose of the security. The instant invention provides a video camera that can be serviced from inside a residence wherein the disabling of the camera requires an occupant to simply remove and replace the video assembly from inside the security of the premises.

FIG. 6(*b*) depicts the use of the video assembly 12 in a hazardous location wherein the occupants of one room may be monitored through the safety of the video camera. The hazardous room may contain volatile gases or the like which could overcome an individual who worked in the room. For instance, a paint booth can be a hazard to any individual yet the thru-hull video camera provides viewing when necessary and ease of camera removal while in a non-hazardous area. In this manner the thru-hull assembly may be constructed of an explosion proof assembly with all the materials epoxied inside of a housing that could be easily replaced by an individual outside the hazardous area.

FIG. 6(*c*) depicts a known problem with vans in that the back area of the van presents a blind spot. This is further illustrated by airport transport vans which constantly shuttle passengers from the airport to car rental locations. The need for monitoring what is happening directly behind the vehicle is critical. Rearview mirrors provide insufficient viewing due to the length of the vehicle. For this reason, video cameras have been mounted on the outside of such vehicles providing a direct view of the blind spot behind the vehicle. The problem to which the thru-hull device addresses, is a need for constant cleaning of the camera to maintain operation. For example, buses typically cause a station wagon effect wherein road dirt grime and road salt can quickly cover the back of a bus making it impossible to see. If a video camera is mounted on the outside of the vehicle it will be coated making it inoperable for its intended purpose. The driver must stop and exit the vehicle to clean the lens to restore optical viewing or ignore items in the blind spot. This can be a dangerous proposition at an airport where a bus driver must frequently stop to pick up passengers and unless the clarity is there, would have to exit the vehicle and expose himself to traffic. The instant invention allows a thru-hull fitting to be placed in the rear of the bus wherein cleaning can be performed by un-threading the end cap and simply pulling the video camera assembly through the thru-hull for cleaning of the lens. In this manner, a bus driver can clean the camera while being safely situated inside the bus. The operator need only stop the bus, walk to the rear of the bus, and remove the camera assembly through the thru-hull, use a tissue to clean the lens and then simply insert the camera assembly back through the thru-hull. This will allow the bus driver to maintain clarity and instantly service the device as needed.

FIG. 6(*d*) depicts yet another example of this usage wherein a trailer may have a video camera mounted in a rear panel to allow the driver to view the occupants or objects directly behind the vehicle. The thru-hull assembly allows the video assembly to be easily removed should the trailer be detached or while loading product to prevent damage to the camera. In this manner, a tractor which is used to pull numerous trailers may have one video camera assigned to it wherein the driver will transfer the camera from trailer to trailer maintaining responsibility for the camera and preventing damage when it is not in use.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

I claim:

1. In a combination of a boat and a video camera for underwater viewing, said boat having at least one aperture through the hull below the waterline, and a conventional through-hull fitting, said fitting composed of a non-ferrous coupling fixed in said aperture having a tubular portion with an inner end located in said boat and an outer end extending through the hull, an integral flange on said outer end, said flange providing permanent connection to said exterior of said hull about said aperture, an internal coupling connected in a watertight manner to said inner end of said tubular portion, the improvement comprising an underwater video camera contained within a rigid cylindrical sleeve, said sleeve sized for insertion into said conventional through-hull fitting, said rigid cylindrical sleeve inserted through said internal coupling into said tubular portion of said through-hull fitting, said rigid cylindrical sleeve having a transparent panel closing one end, said transparent panel disposed in the outer end of said tubular portion of said through-hull fitting, the other end of said rigid cylindrical sleeve having means forming a releasable watertight seal between said sleeve and said internal coupling of said through-hull fitting, a video camera contained within said rigid cylindrical sleeve, said camera having a lens and connecting cables, said camera being positioned such that said lens is juxtaposed to said transparent panel and said cables extend from and are engaged with said other end of said rigid cylindrical sleeve.

2. In a combination as claimed in claim 1 wherein said means for forming a releasable watertight seal with said other end of said rigid cylindrical sleeve and said internal coupling comprises a threaded end cap and cooperating threads on said internal coupling.

3. In a combination as claimed in claim 2 wherein said other end of said rigid cylindrical sleeve includes at least one annular groove, a resilient O ring disposed in said groove whereby a releasable seal is established through the cooperating threads of said end cap and said internal coupling.

4. In a combination as claimed in claim 1 wherein said rigid cylindrical sleeve has at least one external circumferential groove intermediate the ends and a resilient O ring disposed therein, said O ring providing a seal between said rigid cylindrical sleeve and said tubular portion of said through-hull fitting.

5. In a combination as claimed in claim 1 wherein a field of view is defined through said transparent panel in a direction parallel to the axis of said rigid cylindrical sleeve.

6. In a combination as claimed in claim 5 wherein a field of view is between 0 and 90 degrees.

7. In a combination as claimed in claim 5 wherein a field of view is adjustable.

* * * * *